US008490255B1

(12) United States Patent
Alhanati et al.

(10) Patent No.: US 8,490,255 B1
(45) Date of Patent: Jul. 23, 2013

(54) ARTICLE SECURING APPARATUS

(76) Inventors: Theresa L. Alhanati, Lake Forest, CA (US); Joe E. Alhanati, Lake Forest, CA (US)

( * ) Notice: Subject to any disclaimer, the term of this patent is extended or adjusted under 35 U.S.C. 154(b) by 285 days.

(21) Appl. No.: 12/771,758

(22) Filed: Apr. 30, 2010

Related U.S. Application Data

(60) Provisional application No. 61/174,020, filed on Apr. 30, 2009.

(51) Int. Cl.
*A47G 25/12* (2006.01)
*A45B 1/00* (2006.01)

(52) U.S. Cl.
USPC ..... 24/300; 24/302; 24/306; 135/16; 297/184.15; 297/184.16; 248/524; 248/540; 248/205.2

(58) Field of Classification Search
USPC ..... 24/298–302, 306; 248/523, 524, 248/534, 539, 540, 205.2; 135/16, 19, 33.4; 297/184.15, 188.2, 184.16; 224/186–190
See application file for complete search history.

(56) References Cited

U.S. PATENT DOCUMENTS

| | | | | | |
|---|---|---|---|---|---|
| 774,143 | A * | 11/1904 | Adams | 224/220 |
| 1,352,332 | A * | 9/1920 | Weinberg et al. | 135/44 |
| 2,134,242 | A * | 10/1938 | Wade | 47/47 |
| 2,994,300 | A * | 8/1961 | Grahling | 119/770 |
| 3,170,665 | A * | 2/1965 | Ryan | 248/311.2 |
| 3,232,664 | A * | 2/1966 | McBride | 297/184.15 |
| 4,334,692 | A * | 6/1982 | Lynch | 224/274 |
| 4,924,896 | A * | 5/1990 | Carter | 135/90 |
| 4,989,811 | A * | 2/1991 | Millis et al. | 248/104 |
| 5,130,899 | A * | 7/1992 | Larkin et al. | 362/570 |
| 5,503,316 | A * | 4/1996 | Stewart | 224/312 |
| 5,513,786 | A * | 5/1996 | Drane | 224/188 |
| 5,535,928 | A | 7/1996 | Herring | |
| 5,609,321 | A | 3/1997 | McClellan | |
| 5,749,386 | A * | 5/1998 | Samuel, Jr. | 135/16 |
| 5,762,308 | A * | 6/1998 | Bryan | 248/314 |
| 5,927,661 | A * | 7/1999 | Tinsley et al. | 248/102 |
| 6,039,061 | A * | 3/2000 | Utley | 135/16 |
| 6,049,953 | A | 4/2000 | McCay | |
| 6,244,557 | B1 * | 6/2001 | Maze | 248/541 |
| 6,931,782 | B1 * | 8/2005 | Pitcock | 43/21.2 |
| 7,226,126 | B1 * | 6/2007 | Spanovich | 297/184.16 |
| 7,527,330 | B2 * | 5/2009 | Montpas | 297/184.15 |
| 8,132,582 | B2 * | 3/2012 | Goebel | 135/16 |
| 2001/0035202 | A1 * | 11/2001 | Moskowitz et al. | 135/16 |
| 2007/0096004 | A1 | 5/2007 | Quiambao | |

* cited by examiner

*Primary Examiner* — Robert J Sandy
*Assistant Examiner* — Rowland D Do
(74) *Attorney, Agent, or Firm* — TechLaw LLP; Jonathan A. Kidney

(57) ABSTRACT

An apparatus for securing an article to an external object includes at least one cuff member. The at least one cuff member may be adapted to receive a portion of the article. Further, the at least one cuff member may include a strap member extending from an outer surface thereof. The strap member is adapted to be adjustably wrapped and secured around the at least one cuff member and a portion of the external object for securing the article to the external object.

5 Claims, 3 Drawing Sheets

ARTICLE SECURING APPARATUS

CROSS REFERENCE TO RELATED APPLICATION

This application claims the benefit of U.S. Provisional Application No. 61/174,020 filed on Apr. 30, 2009 the disclosure of which is incorporated by reference.

FIELD OF THE INVENTION

The present disclosure generally relates to article securing apparatuses, and, more particularly, to an apparatus for securing an umbrella to an external object.

BACKGROUND OF THE INVENTION

Individuals frequently indulge in recreational and leisurely activities, such as watching football games, baseball games, swim meets, sun bathing, reading newspapers and the like. Frequently, such recreational and leisurely activities are performed by individuals while being seated on a chair. Moreover, such recreational and leisurely activities are often carried out in the open where the individuals may be exposed to the sun. Such exposure may cause sunburn, sun blindness, and other discomforts.

To help prevent such discomforts, individuals may employ a shade-providing apparatus, such as an umbrella. The umbrella is usually held upwardly and is therefore required to be held in a user's hand, placed on a chair or partially inserted into the ground. However, positioning of the umbrella using such methods for an extended period of time may prove to be bothersome and tiring for the individuals. Moreover, placement of the umbrella on a chair often results in tilting of umbrella in an undesired orientation, which fails to protect the individuals from the sun. Furthermore, insertion of a portion of the umbrella into the ground may be difficult or impossible when the ground is made of hard materials, such as concrete.

SUMMARY OF THE INVENTION

One embodiment of an apparatus for securing an article to an external object includes at least one cuff member. The at least one cuff member may be adapted to receive a portion of the article. Further, the at least one cuff member may include a strap member extending from an outer surface thereof. The strap member is adapted to be adjustably wrapped and secured around the at least one cuff member and a portion of the external object for securing the article to the external object.

BRIEF DESCRIPTION OF THE DRAWINGS

These and other features and advantages of the present disclosure will be apparent from the following detailed description, appended claims, and accompanying drawings in which:

DETAILED DESCRIPTION

The exemplary embodiments described herein in detail for illustrative purposes are subject to many variations in structure and design. It should be emphasized, however, that the present disclosure is not limited to a particular apparatus for securing an article to an external object as shown and described. It is understood that various omissions and substitutions of equivalents are contemplated as circumstances may suggest or render expedient, but these are intended to cover the application or embodiment without departing from the spirit or scope of the claims of the present disclosure. Also, it is to be understood that the phraseology and terminology used herein are for the purpose of description and should not be regarded as limiting.

The use of "including," "comprising," or "having" and variations thereof herein is meant to encompass the items listed thereafter and equivalents thereof as well as additional items. The terms such as "first," "second," "outer," "inner" and other variations thereof as used herein, do not denote an order, elevation or importance, but rather used signify the presence of at least one of the referenced item. Further, the terms, "a" and "an" herein do not denote a limitation of quantity, but rather denote the presence of at least one of the referenced item.

Figure 1:
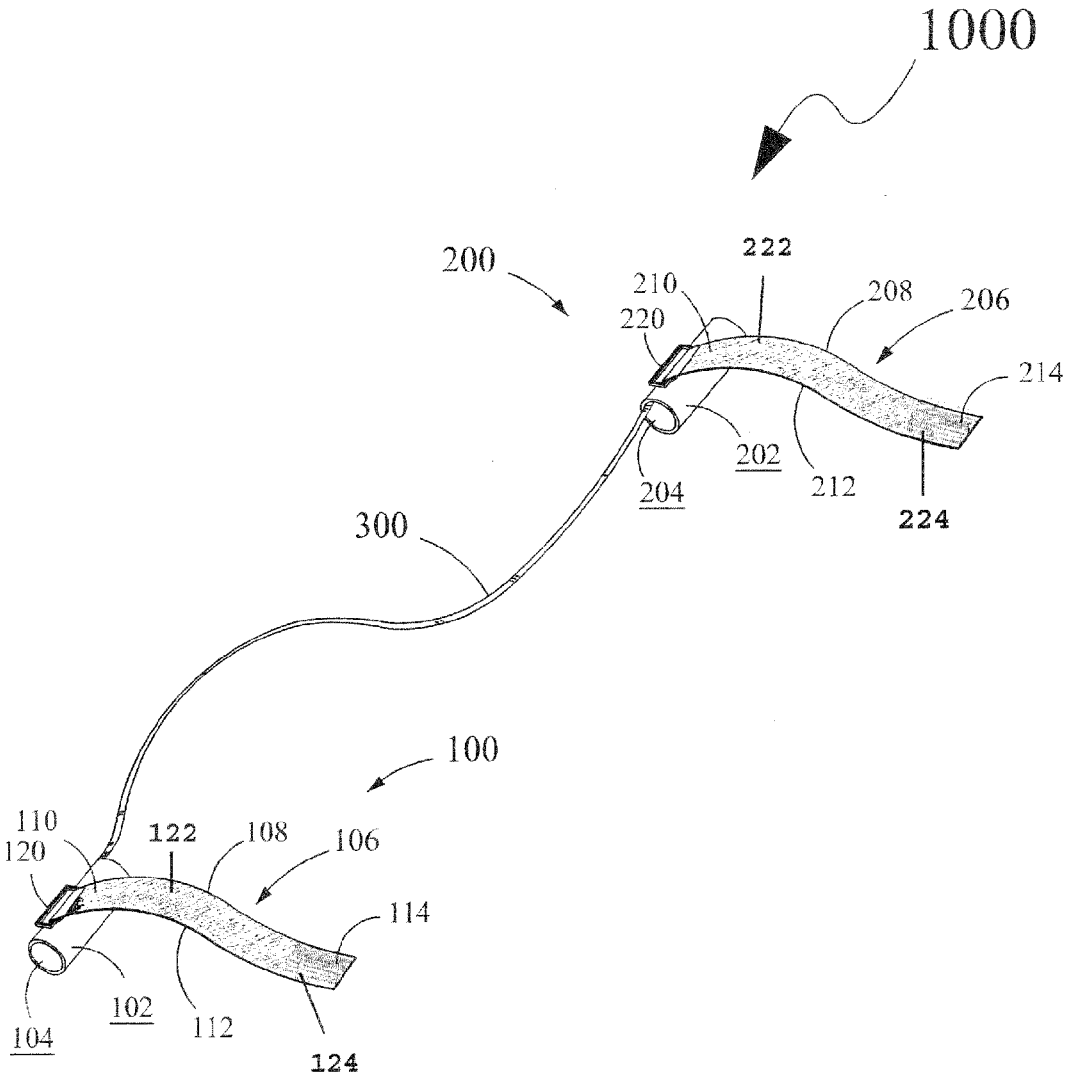
FIG. 1 is a perspective view of one embodiment of an apparatus for securing an article (hereinafter referred as "article securing apparatus") to an external object.
Figure 2:
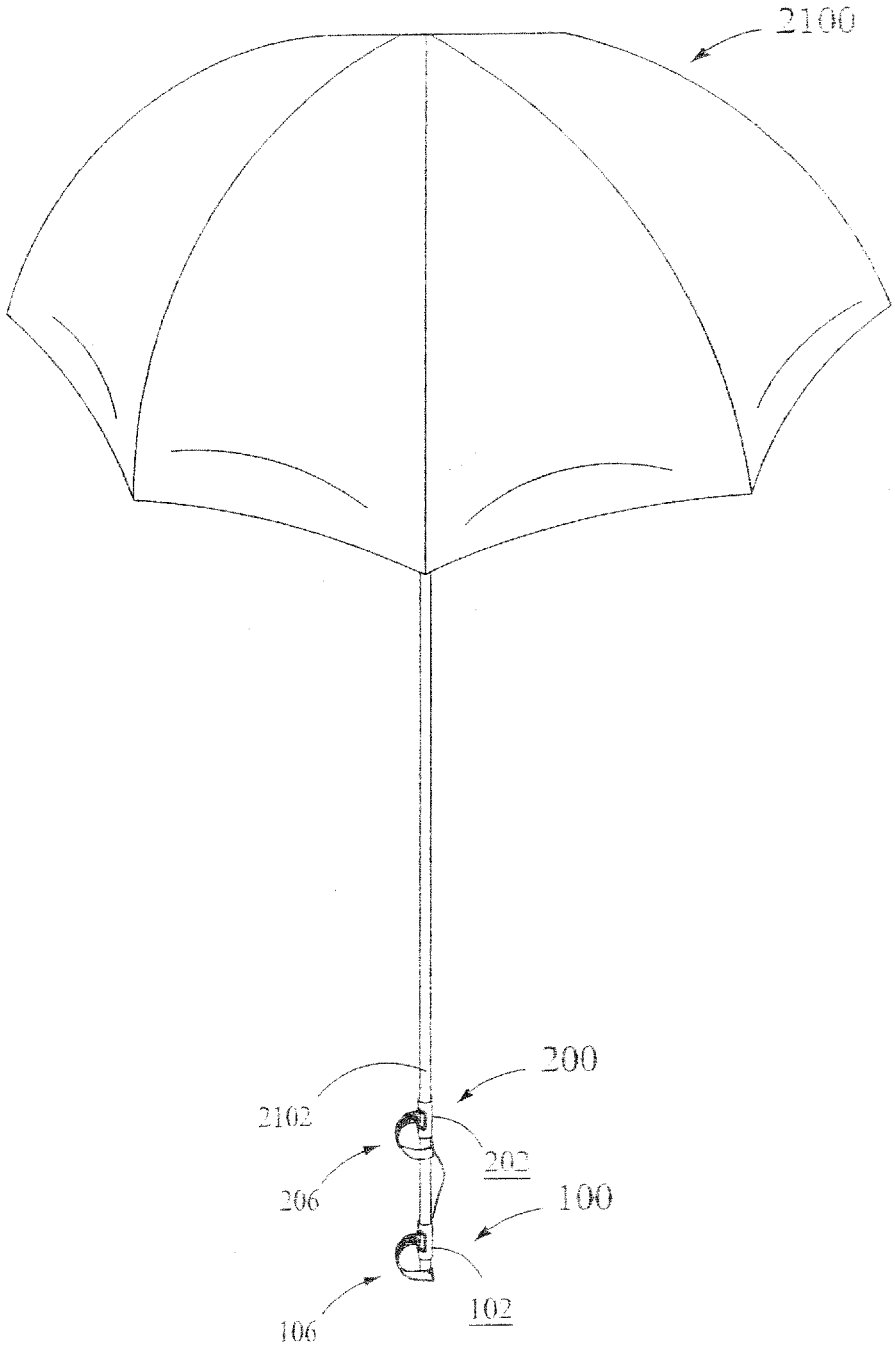
FIG. 2 is a perspective view of the article securing apparatus of FIG. 1 attached to the article.
Figure 3:
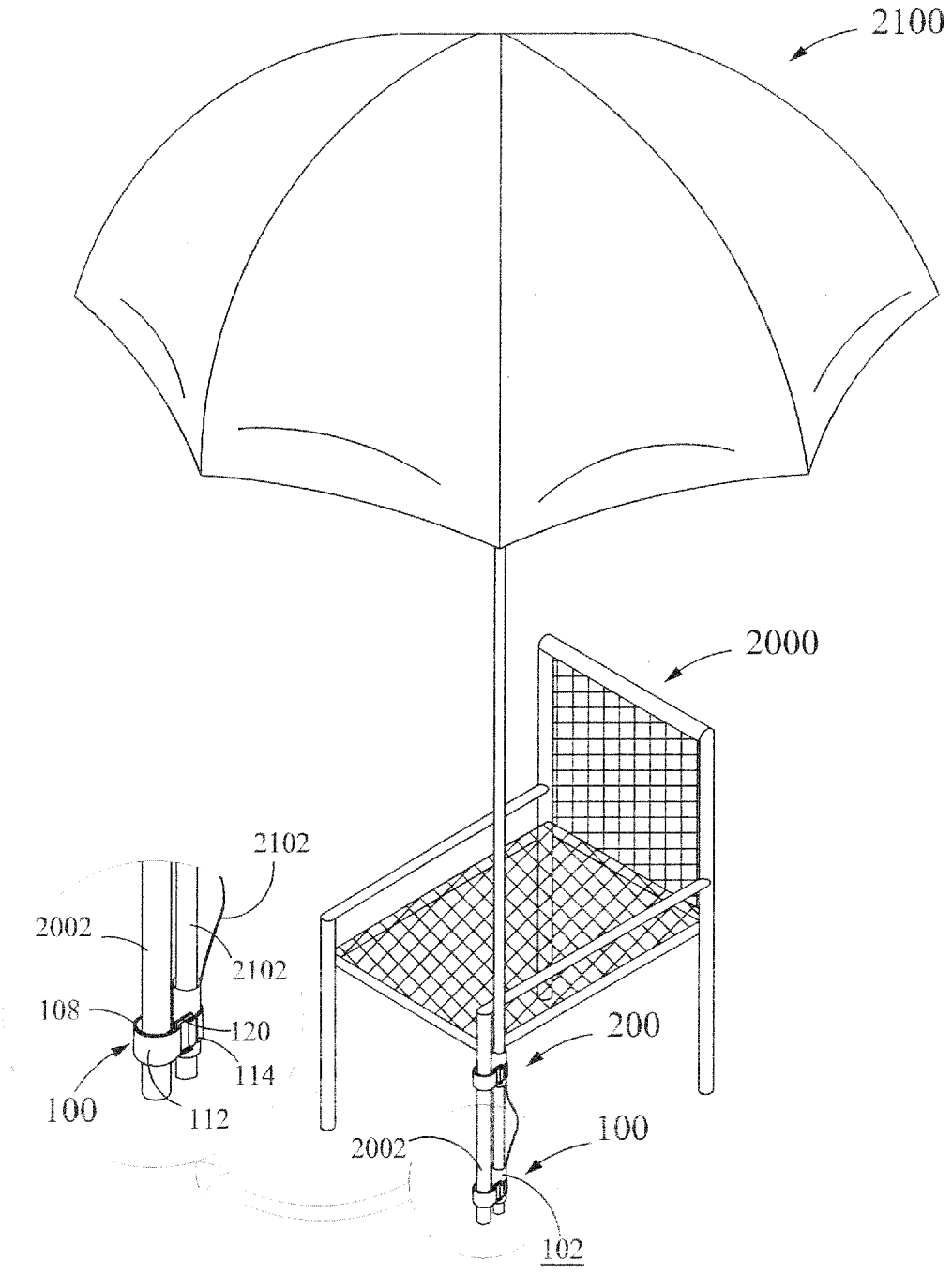
FIG. 3 is a perspective view of the article securing apparatus of FIG. 1 in a utilized state.

Referring to FIGS. 1-3, one embodiment of an apparatus 1000 for securing an article to an external object (hereinafter referred to as "article securing apparatus 1000") is shown. In one embodiment, the article securing apparatus 1000 may be utilized for securing an article 2100, such as an umbrella, to an external object 2000, such as a chair. Other examples of the external objects to which such an article may be secured include a bleacher, a stroller, an ice chest and the like.

The article securing apparatus 1000 may include at least one cuff member. In a particular embodiment, the article securing apparatus 1000 includes a plurality of cuff members, such as a first cuff member 100 and a second cuff member 200. Each of the first cuff member 100 and the second cuff member 200 is configured to receive therein a portion 2102 of the article 2100. The cuff members may be configured to receive any desired portion of any article to be secured to the external object 2000. That is, in different embodiments, the shapes and sizes of the cuff members may be varied as needed to receive portions of particular articles therein.

In one embodiment, the first cuff member 100 and the second cuff member 200 include an outer surface 102 and an outer surface 202, respectively. Each of outer surface 102 and the outer surface 202 may include a coating of a nylon material However, it should be understood that such use of nylon material should not be construed as a limitation to the present disclosure. The first cuff member 100 and the second cuff member 200 may further include an inner surface 104 and an inner surface 204 respectively. Each of the inner surface 104 and the inner surface 204 may be composed of a neoprene material. However, it should be understood that such use of neoprene material should not be construed as a limitation to the present disclosure. Alternatively, each of the inner surface 104 and the inner surface 204 may be composed of any other resiliently compressible material.

Because the resiliently compressible material(s) of the cuff member inner surfaces resiliently compresses or deflects outwardly or away from the elongated portion 2102 responsive to insertion of the elongated portion into the cuff members, the resiliently compressible material of the inner surface 104 and the inner surface 204 facilitates snug fitting of the elongated portion 2102 of the article 2100 in each of the first cuff member 100 and the second cuff member 200. Further, the resiliently compressible material(s) of the inner surface 104 and the inner surface 204 facilitates receiving and securement of different sizes or diameters of elongated portion 2102 of the article 2100. It may be apparent to those skilled in the art that, though the article securing apparatus 1000 is shown and described to include only two cuff members, namely the first cuff member 100 and the second cuff member 200, the article securing apparatus 1000 may include fewer or more such cuff members. For example, in an alternative embodiment of the present disclosure, the article securing apparatus 1000 may include 3 cuff members.

The first cuff member 100 and the second cuff member 200 may include a first strap member 106 and a second strap member 206, respectively. In one embodiment, the first strap member 106 and the second strap member 206 may extend from the outer surface 102 and the outer surface 202 of the first cuff member 100 and the second cuff member 200, respectively.

Each of the first strap member 106 and the second strap member 206 is adapted to be adjustably wrapped and secured around a respective one of cuff member 100 and cuff member 200, and also around a portion of the external object 2000 to which the article 2100 is to be secured. Specifically, each of the first strap member 106 and the second strap member 206 is adapted to be wrapped around the respective cuff member to which it is attached, and also around an elongated portion, such as a portion 2002, of the external object 2000 for securing the article 2100 to the external object 2000. However, it should be understood that such wrapping of the first strap member 106 and the second strap member 206 around the elongated portion, such as the portion 2002, of the external object 2000 should not be construed as a limitation to the present disclosure. For example, in an alternative embodiment, strap member 106 may be wrapped around a portion of the external object different from the portion around which strap member 206 is wrapped. Accordingly, the first strap member 106 and the second strap member 206 may be wrapped around tubular portions, such as tubular frames, of the external object 2000. Alternatively, the strap members 106 and 206 may be wrapped around any portion or portions of the external object 2000 around which the strap members may extend and be secured. The strap members 106 and 206 may have any lengths suitable for a particular application.

The first strap member 106 and the second strap member 206 may include a buckle member, such as a buckle member 120 and a buckle member 220 respectively. The buckle member 120 may be sewn or otherwise suitably attached to the outer surface 102 of the first cuff member 100 of the plurality of cuff members. Similarly, the buckle member 220 may be sewn or otherwise suitably attached to the outer surface 202 of the second cuff member 200 of the plurality of cuff members.

Further, the first strap member 106 may include a belt member 108. The belt member 108 may include a first end portion 110, a body portion 112 and a second end portion 114 opposite to the first end portion 110.

The first end portion 110 of the belt member 108 may be coupled to the buckle member 120. In one embodiment, the first end portion 110 of the belt member 108 may be sewn or otherwise suitably attached to the cuff member 100 proximate the buckle member.

The body portion 112 and the second end portion 114 of the belt member 108 may include a first fastening element 122 and a second fastening element 124, respectively. These fastening elements are provided for securing the article 2100 to the external object 2000. In one embodiment, the first fastening element 122 includes a first lining of a loop material applied to a surface of the body portion 112, and the second fastening element 124 includes a complementary lining of a hook material applied to a surface of the second end portion 114. The body portion 112 is adapted to be wrapped around the outer surface 102 of the first cuff member 100 and around portion 2002 of the external object 2000 such that the loop material on body portion 112 faces outwardly (i.e., from the cuff member 100 and the external object). In one embodiment, as best shown in FIG. 3, the body portion 112 is adapted to be wrapped around both cuff member 100 and a leg or other suitable feature of the external object 2000. Further, the second end portion 114 of the belt member 108 is fed through buckle member 120 in a first direction, and then pulled taught in the opposite direction to hold the cuff member against the portion of the external object. The second end portion 114 is then pressed against body portion 112 so that the hook material on end portion 114 engages the loop material positioned along the exterior-facing surface of body portion 112, thereby securing body portion 112 in the taught position. In this manner, the cuff member 100 is secured against the external object.

The second strap member 206 may include a belt member 208. The belt member 208 includes a first end portion 210, a body portion 212 and a second end portion 214 opposite to the first end portion 210.

The first end portion 210 of the belt member 208 may be coupled to the buckle member 220. In one embodiment, the first end portion 210 of the belt member 208 may be sewn or otherwise suitably attached to the cuff member 200 proximate the buckle member. Similar to the first strap member 106, the body portion 212 and the second end portion 214 of the belt member 208 of the second strap member 206 may include a first fastening element 222, and a second fastening element 224, for securing the article 2100 external object 2000. In one embodiment, the first fastening element 222 includes a first lining of a loop material applied to a surface of the body portion 212, and the second fastening element 224 includes a complementary lining of a hook material applied to a surface of the body portion second end portion 214 The body portion 212 is adapted to be wrapped around the outer surface 202 of the second cuff member 200 and around portion 2002 of the external object 2000 such that the loop material on body portion 212 faces outwardly (i.e., away from the cuff member 200 and the external object). In the embodiment shown in FIG. 3, the body portion 212 is adapted to be wrapped around both cuff member 200 and a leg or other suitable feature of the external object 2000. Further, the second end portion 214 of the belt member 208 is fed through buckle member 220 in a first direction, and then pulled taught in the opposite direction to hold the cuff member against the portion of the external object. The second end portion 214 is then pressed against body portion 212 so that the hook material on end portion 214 engages the loop material positioned along the exterior-facing surface of body portion 212, thereby securing the body portion 212 in the taught position. In this manner, the cuff member 200 is secured against the external object.

As best shown in FIG. 1, the article securing apparatus 1000 further includes at least one flexible string member, such as a flexible string member 300. In a particular embodiment, the article securing apparatus 1000 includes a plurality of flexible string members. Each flexible string member, such as the flexible string member 300 connects a pair of cuff members, such as the first cuff member 100 and the second cuff member 200 of the plurality of cuff members for stringing together the plurality of cuff members. The flexible string member 300 may also facilitate movement of the first cuff member 100 with respect to the second cuff member 200 while preventing the cuff members from becoming detached from one another.

During utilization of the article securing apparatus 1000, each of the first cuff member 100 and the second cuff member 200 are slipped over the elongated portion 2102 of the article 2100. Thereafter, each of the first strap member 106 and the second strap member 206 is wrapped around a suitable portion 2002 of the external object 2000, for securing the article 2100 to the external object 2000. Specifically, the body portion 112 of the first strap member 106 may be wrapped around the cuff portion of 2102 and the portion 2002 of the external object 2000, as previously described. Subsequently, the second end portion 114 of the belt member 108 is passed through the buckle member 120 and pulled for tightening the belt member 108 wrapped around the portion 2002 of the external object 2000, as previously described. Thereafter, the first fastening element 122 is engaged with the second fastening element 124 for securing the article 2100 to the external object 2000. Further, the body portion 212 of the second strap member 206 may be wrapped around the cuff portion of 2102 and the portion 2002 of the external object 2000, as previously described. Subsequently, the second end portion 214 of the belt member 208 is passed through the buckle member 220 and pulled for tightening the belt member 208 wrapped around the portion 2002 of the external object 2000 as previously described. Thereafter, the first fastening element 222 is engaged with the second fastening element 224 for securing the article 2100 to the external object 2000.

The present disclosure provides an article securing apparatus, such as the article securing apparatus 1000, for securing articles, such as the article 2100, to an external object such as the external object 2000. In one exemplary embodiment, the article 2100 may be an umbrella and the external object 2000 is a chair. The article securing apparatus 1000 includes cuff members, such as the first cuff member 100 and the second cuff member 200, adapted to receive a portion of the article. The article securing apparatus 1000 further includes strap members, such as the first strap member 106 and the second strap member 206 adapted to attach the article to the external object 2000. Thus, in the particular embodiment previously described, the disclosed article securing apparatus 1000 precludes the need of holding umbrella while sitting in the chair. The disclosed article securing apparatus 1000 further precludes the need of placing the umbrella in an unsecured state.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. An apparatus for securing a sun umbrella to an object, the apparatus comprising:

a first cuff member substantially cylindrical in shape and hollow, to allow a portion of a pole of the sun umbrella to be inserted and partially supported therein;

a second cuff member substantially identical to the first cuff member, to allow another portion of the pole of the sun umbrella to be inserted and partially supported therein, wherein an interior portion of each cuff member is surfaced with a cushioning material that resiliently receives and operates to secure the inserted portions of the pole of the umbrella;

a flexible cord coupled to the first and second cuff members, allowing the first and second cuff members to be separated at variable distances from each other along the partially supported pole portions of the sun umbrella; and a flexible strap member with a self gripping mechanism, extending from an outer surface of each cuff member, each flexible strap also having a buckle member proximal to the respective cuff, wherein the combination of the flexible straps, buckles, separated cuffs, and cushioning material, solely operate to allow the sun umbrella to be secured to an object.

2. The apparatus of claim 1, wherein an outer surface of the at least one cuff member comprises a coating of a nylon material.

3. The apparatus according to claim 1, wherein the flexible strap members' gripping mechanism is a loop and hook mechanism.

4. The apparatus of claim 1, further comprising the sun umbrella having a pole section inserted into the cuff members.

5. The apparatus according claim 4, further comprising a chair, wherein the cuff members are secured to a weight supporting member of the chair.

* * * * *